United States Patent [19]

Boyd

[11] 4,301,587

[45] Nov. 24, 1981

[54] MACHINE FOR CLOSING STANDING SEAMS OF SHEET METAL ROOFING

[76] Inventor: Thomas J. Boyd, Rte. 1, Box 500, Wellsburg, W. Va. 26070

[21] Appl. No.: 128,403

[22] Filed: Mar. 10, 1980

[51] Int. Cl.[3] ..... B23P 11/00

[52] U.S. Cl. ..... 29/243.5

[58] Field of Search ..... 29/243.5; 113/54, 55, 113/56

[56] References Cited

U.S. PATENT DOCUMENTS

| | | | |
|---|---|---|---|
| 1,976,148 | 10/1934 | Sonntag | 113/55 |
| 2,160,336 | 5/1939 | Maxfield | 113/55 |
| 3,609,845 | 10/1971 | Taylor | 29/243.5 |
| 3,771,482 | 11/1973 | Thompson | 113/55 |
| 3,773,005 | 11/1973 | Day et al. | 113/55 |
| 3,877,286 | 4/1975 | Fontaine et al. | 113/54 |
| 4,072,118 | 2/1978 | Schultheiss | 29/243.5 |

*Primary Examiner*—James L. Jones, Jr.

*Attorney, Agent, or Firm*—Brown, Flick & Peckham

[57] ABSTRACT

Suspended from a carriage that straddles a standing seam, in which the upper portions of adjoining upright flanges are interlocked, is a vise having a pair of normally spaced jaws with a short length of the standing seam between them. One of the jaws is rigidly connected to the carriage, but the other jaw can be moved toward and away from the first jaw by a fluid pressure cylinder supported by the carriage. The movable jaw is moved toward the other jaw periodically to compress and close the interlocked upper portions of the seam. Each time the jaws are separated the carriage can be moved along the seam in order to close an adjoining length of the seam. Preferably, the carriage is moved along the seam automatically by means of motor-driven rollers that frictionally engage the standing seam. The rollers are rotated to move the carriage only while the vise is released from the seam.

10 Claims, 6 Drawing Figures

MACHINE FOR CLOSING STANDING SEAMS OF SHEET METAL ROOFING

Standing seams of sheet metal roofing are formed by turning up the edges of sheet metal panels to provide upright flanges and then placing the flanges of adjoining sheets or panels face to face in engagement with each other. The upper portions of the flanges are interlocked in a well known manner. For roof pitches greater than about three inches per foot there is no need to close the interlocked area of the seam. A different type of standing seam has been used for roofs of lesser pitch, and the seams have been soldered. Soldering not only is slow, but it is becoming more and more difficult to find workmen skilled in soldering standing seams.

It is among the objects of this invention to provide a machine for closing interlocked standing seams so that interlocked seams can be used for flat and low pitched roofs, which applies high pressure to the seams and which can be moved automatically along a seam intermittently to compress and close successive lengths of the seam.

The preferred embodiment of the invention is illustrated in the accompanying drawings, in which FIG. 1 is a side view;

Figure 1:
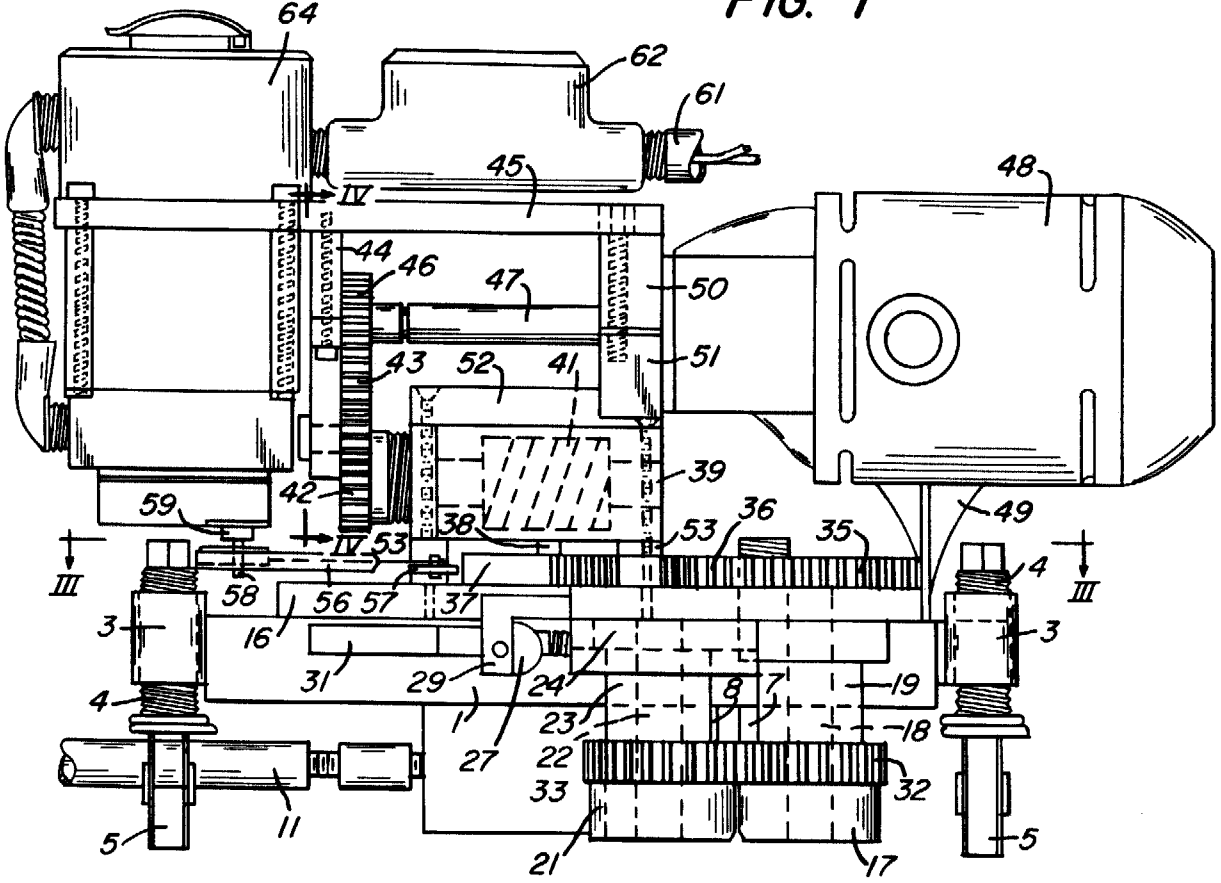
Figure 2:
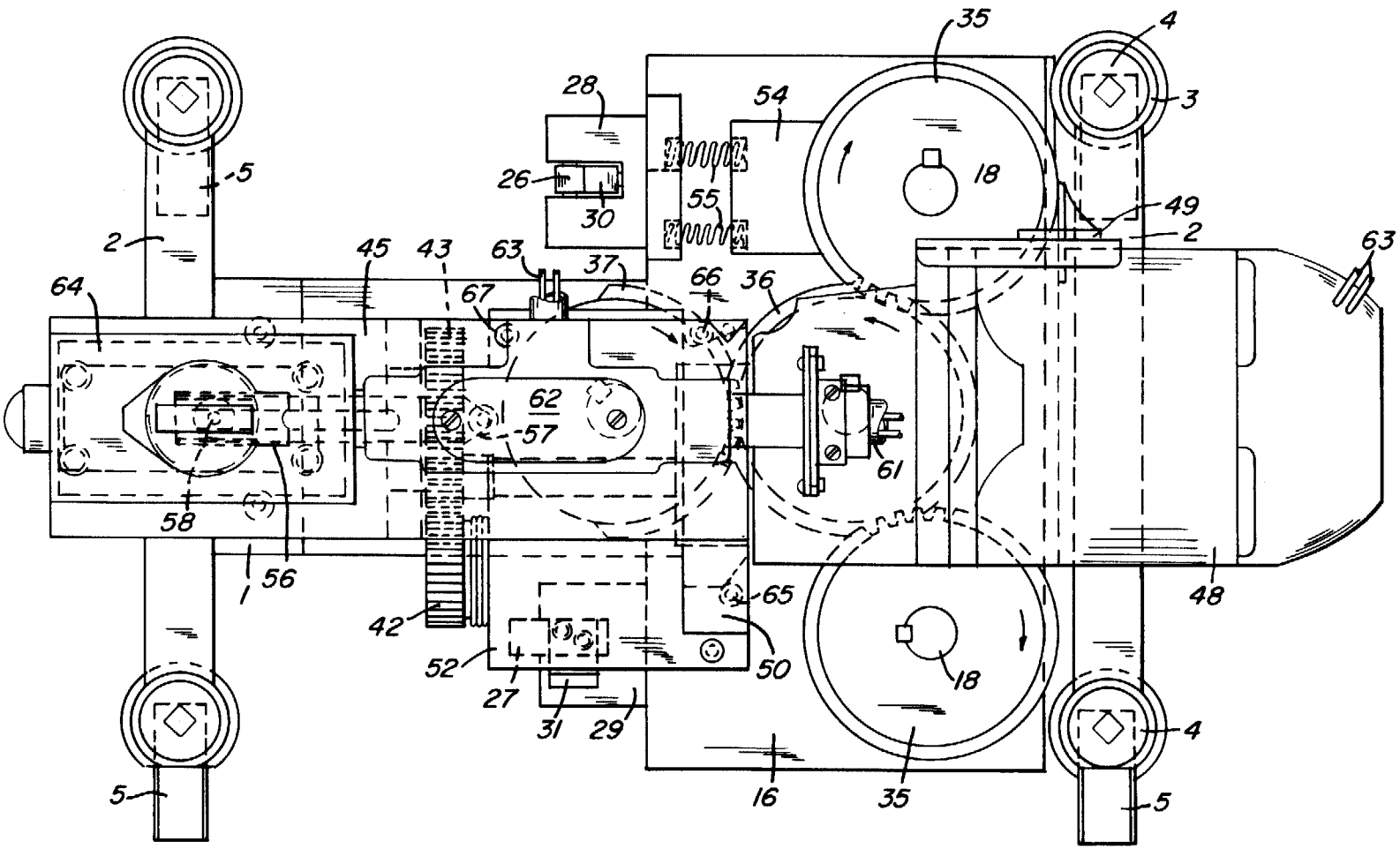
FIG. 2 is an enlarged plan view.
Figure 3:
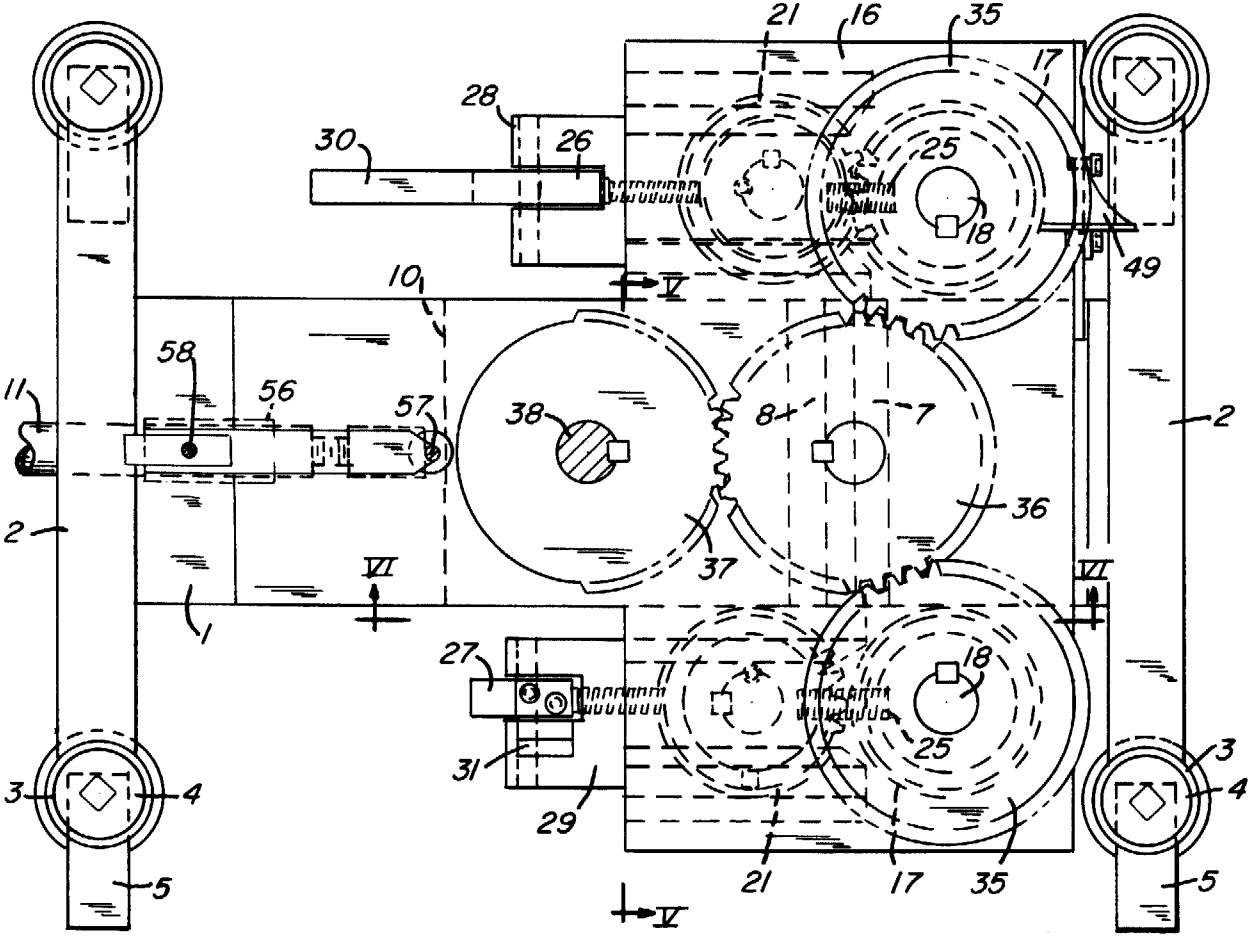
FIG. 3 is an enlarged horizontal section taken on the line III—III of FIG. 1 and showing one of the driving rolls released.

Referring to FIGS. 1 to 3 of the drawings, a carriage is formed from a rectangular metal plate 1 joined to crossbars 2 at its opposite ends. Rigidly mounted on the ends of each crossbar there are internally threaded sleeves 3, in which the threaded posts 4 of casters 5 are mounted. By screwing the posts up or down in the sleeves, the height of the plate above roofing sheets can be adjusted for standing seams of different heights.

Figure 6:
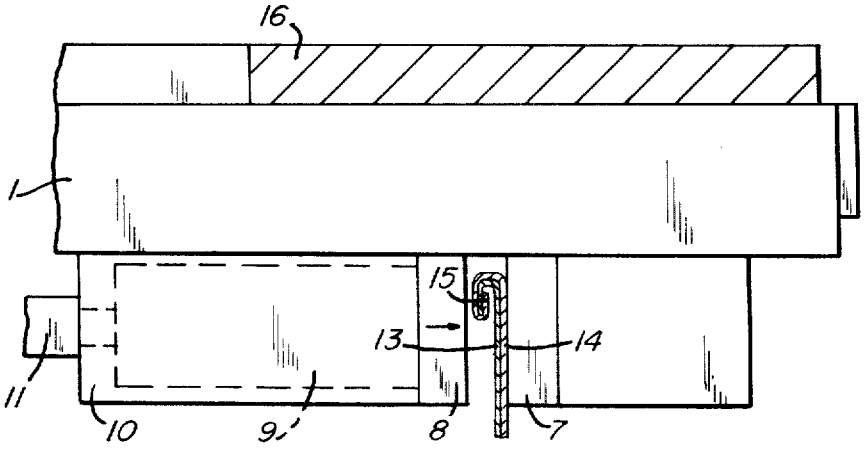
FIG. 6 is an enlarged fragmentary longitudinal section taken on the line VI—VI of FIG. 3.

Suspended from the carriage plate is a vise. As best shown in FIG. 6, one jaw 7 of the vise is rigidly connected to the bottom of the plate near one end of the carriage, while the other jaw 8 is mounted on the outer end of piston 9 slidably mounted in a fluid pressure cylinder 10 secured to the bottom of the plate. The two rectangular jaws extend transversely of the plate. A hose 11 is connected to one end of the cylinder for delivering fluid under pressure to it in order to force the movable jaw toward the fixed jaw. Preferably, hydraulic pressure is used, which is supplied by a separate hydraulic unit (not shown) connected with the flexible hose. The piston 9 is the spring-return type so that when the delivery of hydraulic pressure to the cylinder is cut off, the movable jaw will be retracted against the cylinder to open the vise.

To close and seal an interlocked standing seam, the carriage is placed on a sheet metal roof with plate 1 extending across the seam and with a pair of the casters resting on the roof at each side of the seam. As shown in FIG. 6, the seam is formed by the upturned marginal portions of the sheet metal panels 12, which form upright flanges 13 and 14 disposed face to face in engagement with each other. The upper portion of flange 13 is turned down to form a lip 15. The upper portion of the other flange overlies flange 13 and then extends down past lip 15 and then up between the lip and the body of flange 13 to interlock the two flanges. This is done in conventional manner. With the carriage located in this manner in operating position at one end of the seam, fluid pressure, such as hydraulic pressure, is supplied through hose 11 to the vise cylinder 10 to cause the vise to compress together a short length of the five thicknesses of the interlocked seam that is between the vise jaws, whereby the seam is closed. Since great pressure can be applied by the vise, the seam also is sealed against entrance of water between the flanges. Following this closing and sealing action of the vise, the movable jaw is retracted to release the vise so that the carriage can be moved along the seam a few inches before compressing it again. With vise jaws four inches long, for example, the carriage is moved three and one-half inches each time so that there will be a small overlap of the compressed lengths each time. This intermittent movement of the carriage along the seam from one end to the other, interrupted by closing of successive lengths of the seam, can be done manually with manual control of the application of fluid pressure to the vise. However, it is preferred to move the machine and operate the vise automatically, as now will be explained.

Accordingly, as shown in FIG. 3, a T-shape plate is rigidly mounted on the carriage plate 1 to form a table 16 that projects from opposite sides of the carriage plate at the opposite ends of the vise jaws. At least one pair and preferably two pairs of rollers are mounted below the laterally projecting portions of the table on vertical axes. As shown in FIGS. 1 and 3, the two rollers 17 nearer the casters are rigidly mounted on the lower ends of vertical shafts 18 journaled in bearing 19 secured to the bottom of the table. The shafts extend up through the table. The points on these two rollers farthest from the adjacent crossbar 2 are substantially in line with the clamping surface of the stationary jaw 7 of the vise. The other two rollers 21 are rigidly mounted on the lower ends of shafts 22 journaled in blocks 23 supported beneath the table in guideways 24 that permit the blocks to be moved toward and away from the bearings 19 for the fixed rollers. The blocks normally are urged away from the fixed rollers by coil springs 25, but they can be moved in the opposite direction by cams 26 and 27 rotatably mounted in brackets 28 and 29, respectively, secured to the table. When levers 30 and 31 extending upwardly from the cams are swung down, the movable rollers will be moved forward and pressed against the adjacent upstanding flange 13. The two flanges will be clamped between rollers 17 and 21 so that when the rollers are driven they will travel along the flanges and the carriage will be moved along the seam. In FIG. 3 lever 30 is shown swung down while lever 31 is still upright. When both levers are down, the rollers of each pair are geared together by gears 32 and 33 rigidly mounted on them. Preferably, the rollers are knurled for better frictional engagement with the standing seam.

Figure 4:
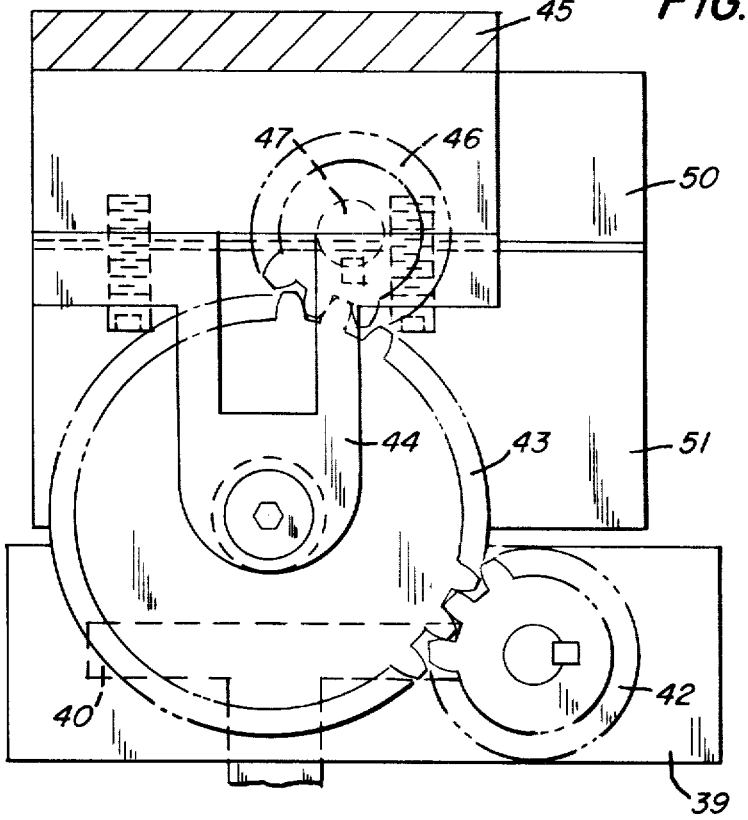
FIG. 4 is a further enlarged vertical section taken on the line IV—IV of FIG. 1.
Figure 5:
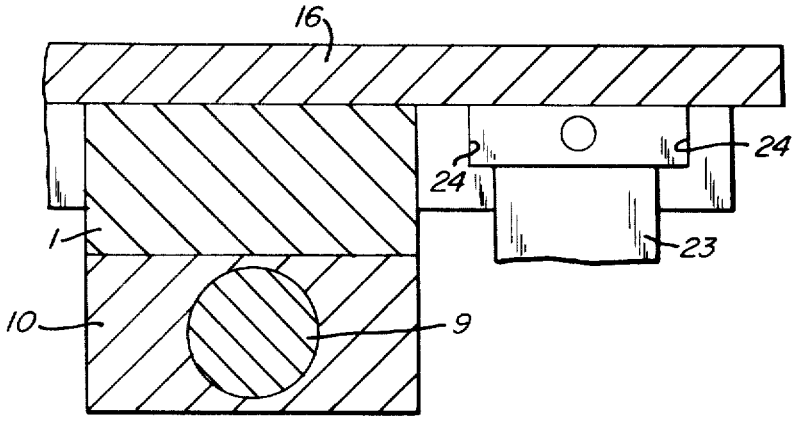
FIG. 5 is an enlarged fragmentary cross section taken on the line V—V of FIG. 3.

For driving the rollers, a gear 35 above the table is rigidly mounted on the upper end of the shaft 18 for each fixed roller. These two gears are rotated in unison in the same direction by an idler gear 36 rotatably mounted on the table between them. The idler gear is driven by a mutilated gear 37, in which the teeth extend only about half way around the gear. This gear is rigidly mounted on the lower end of a shaft 38 extending down out of a gear box 39. As shown in FIG. 4, inside the box a worm gear 40 is mounted on the upper end of shaft 38 and engages a horizontal worm 41 (FIG. 1) that is driven from outside the box by a vertical pinion 42 which, in turn, meshes with a large vertical idler gear 43 mounted in a bracket 44 that helps support a top plate 45. The idler gear 43 is driven by a pinion 46 on the horizontal drive shaft 47 of an electric motor 48 as shown in FIG. 1. The motor is supported by a bracket 49 from one end of table 16. Clamped onto the front end of the motor are blocks 50 and 51 that support one end of top plate 45. The blocks are supported by a plate 52 on gear box 39, which in turn is supported by spacers 53 secured between the gear box and table 16.

While the mutilated gear 37 is in mesh with the idler gear 36, as shown in FIG. 3, the knurled rollers are driven and the machine will be moved by them along the seam, assuming that both cam levers 30 and 31 are swung down into their lower positions to press the rollers against the sides of the seam, but as soon as the toothless part of the mutilated gear reaches idler gear 36 the rollers and machine will stop temporarily. To make sure that the idler gear will not be turned accidentally while the carriage is stationary, which might prevent the mutilated gear from meshing with it, a brake in the form of a block 54 is pressed against one of the driving gears 35 by coil springs 55 as shown in FIG. 2.

At the side of the mutilated gear farthest from gear 36 there is a horizontal lever 56 that extends away from the mutilated gear as shown in FIGS. 1 and 3. The end of the lever next to the mutilated gear carries a roller 57, while the other end of the lever is rigidly connected to the depending shaft 58 of a normally open micro-switch 59 suspended from top plate 45. The roller is in such position that every time the row of teeth on the mutilated gear reach it the foremost tooth swings the lever laterally and thereby causes it to close the switch. The switch is electrically connected to a normally closed solenoid valve (not shown) in the fluid pressure line 11 connecting a constantly operating hydraulic pump with vise cylinder 10. When the switch is closed, it opens the valve and allows hydraulic pressure to be applied to the vise to compress the standing seam. This happens only while the teeth of the mutilated gear are disengaged from the idler gear and the carriage is stationary. The valve is allowed to close to permit the vise to open just before the mutilated gear starts to drive the rollers again to cause the carriage to advance another stop along the standing seam.

Electric power is supplied to the machine through a conduit 61 connected to a conduit box 62 from which wires 63 (FIG. 2) lead to the motor. The box also is connected with an enclosed main switch 64.

With the machine disclosed herein, a standing seam can be closed and sealed quite rapidly and without soldering. If the machine is not equipped with the rollers that grip a standing seam and drive the machine along it, with automatic seam closing periodically, the machine can be pushed along a seam by a workman, who will pause every few inches to manually operate the valve that delivers fluid pressure to the clamping jaws. In either case, the machine is easy to operate and it tightly closes a standing seam. It can be used successfully by an unskilled operator.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A machine for closing and sealing the interlocked upper portions of double-lock standing seams of sheet metal roofing, comprising a carriage adapted to straddle a standing seam, a vise suspended from the carriage and having a pair of normally spaced cooperating jaws adapted to receive a length of the standing seam between them, means connecting one of the jaws to the carriage for movement in a straight line toward and away from the other jaw, and a fluid pressure cylinder supported by the carriage for periodically moving said movable jaw toward the other jaw to compress and close said interlocked upper portions of the seam, the carriage being adapted to be moved a predetermined distance along the seam after each closing operation to close and seal the seam throughout its length.

2. A machine for closing and sealing the interlocked upper portions of double-lock standing seams of sheet metal roofing, comprising a carriage adapted to straddle a standing seam, a vise suspended from the carriage and having a pair of normally spaced cooperating jaws adapted to receive a length of the standing seam between them, a fluid pressure cylinder supported by the carriage for periodically closing the vise to compress and close said interlocked upper portions of the seam, a pair of opposed rollers suspended from said carriage on vertical axes at one end of said jaws and normally spaced apart for receiving the standing seam between them, means for moving one roller laterally toward the other one to tightly engage the seam between them, and means for driving one of said rollers intermittently to move the carriage a predetermined distance along the seam while said vise is open, whereby to close and seal the seam throughout its length.

3. A seam closing machine according to claim 2, including gears rigidly connected with said rollers, said gears meshing when said one roller is moved toward the other roller, whereby the driven roller will drive the other roller.

4. A seam closing machine according to claim 2, in which said roller-moving means include a rotatable cam and a lever secured to the cam for rotating it to push said one roller toward the other roller.

5. A seam closing machine according to claim 2, in which said roller-driving means include a gear rigidly connected with the driven roller, a mutilated gear for rotating the other gear intermittently, and means for driving the mutilated gear continuously.

6. A seam closing machine according to claim 2, including means for activating said fluid pressure cylinder only while said carriage is stationary.

7. A seam closing machine according to claim 2, including electrically operated means for admitting fluid under pressure to said cylinder, and means responsive to said roller-driving means for rendering said electrically operated means inoperative while said rollers are being driven

8. A seam closing machine according to claim 5, including a normally open switch, electrically operated means controlled by said switch when closed for admitting fluid under pressure to said cylinder, and means operated by said mutilated gear while said rollers are idle for closing said switch.

9. A seam closing machine according to claim 5, including a second pair of opposed rollers suspended from said carriage on vertical axes at the opposite end of said jaws, a gear rigidly connected with one of said second pair of rollers, and an idler gear meshing with said mutilated gear and both of said roller-driving gears.

10. A seam closing machine according to claim 9, including a spring-pressed brake frictionally engaging one of said roller-driving gears to hold it stationary while said mutilated gear is out of mesh with said idler gear.

* * * * *